US005080361A

United States Patent [19]

Blanc et al.

[11] Patent Number: 5,080,361

[45] Date of Patent: Jan. 14, 1992

[54] RACKET FOR BALL GAMES

[75] Inventors: Annie Blanc, Villeurbanne; Gilles Du Gardin, Voiron, both of France

[73] Assignee: Skis Rossignol S.A., France

[21] Appl. No.: 549,969

[22] Filed: Jul. 9, 1990

[30] Foreign Application Priority Data

Jul. 19, 1989 [FR] France ..... 89 09961

[51] Int. Cl.[5] ..... A63B 49/02

[52] U.S. Cl. ..... 273/73 C; 273/73 R

[58] Field of Search ..... 273/73 R, 73 C, 73 F, 273/73 G

[56] References Cited

U.S. PATENT DOCUMENTS

| | | | |
|---|---|---|---|
| 1,676,051 | 7/1928 | Robinson | 273/73 H |
| 4,165,071 | 8/1979 | Frolow | 273/73 H |
| 4,280,699 | 7/1981 | Drake | 273/73 H |
| 4,291,574 | 9/1981 | Frolow | 773/73 C |
| 4,561,655 | 12/1985 | Mortvedt | 279/73 H |

FOREIGN PATENT DOCUMENTS

| | | | |
|---|---|---|---|
| 0176021 | 2/1986 | European Pat. Off. . | |
| 3325098 | 1/1985 | Fed. Rep. of Germany | 273/73 C |
| 3715738 | 11/1988 | Fed. Rep. of Germany . | |
| 2172578 | 3/1973 | France . | |
| 2544208 | 9/1984 | France . | |
| 2630336 | 3/1989 | France . | |
| 1536873 | 4/1978 | United Kingdom . | |

*Primary Examiner*—Edward M. Coven
*Assistant Examiner*—Raleigh W. Chiu
*Attorney, Agent, or Firm*—Oliff & Berridge

[57] ABSTRACT

A racket for ball games includes a frame having a shaped cross-section. The shape of the cross-section varies along the periphery of the frame so that the neutral axis of the racket is situated at a varying distance from the internal edge and external edge of the frame along the periphery of the racket. The neutral axis is located closer to the edge being subjected to compressive stress than the edge subjected to tensile stress. The shape of the cross-section may be such that the ratio of the distances between neutral axis and the internal and external edges, respectively, is equal to the ratio of the tensile and compressive strains of the material forming the frame. In four spaced zones of the frame, the neutral axis is closer to the external edge and in four zones spaced intermediate each of the first four zones, the neutral axis is closer to the internal edge of the frame. The cross-section of the frame may have a rounded trapezoidal shape.

17 Claims, 3 Drawing Sheets

RACKET FOR BALL GAMES

BACKGROUND OF THE INVENTION

The present invention relates to a racket for ball games, more particularly intended for the game of tennis, and to be more precise a racket of this type made from a composite material based on a fibrous reinforcement and a matrix of organic material (epoxy resin for example).

The qualities of a racket are determined by several criteria, such as: performance—comfort—cost—strength—appearance.

When the ball is struck, the frame of a racket is subjected to flexural and torsional stresses. Moreover, it is known that a system subjected to a disturbance vibrates at one or more natural frequencies which are characteristic of its structure and result from its distribution of mass and stiffness. These vibrations in turn induce substantial stresses in the frame of the racket. The combination of these stresses is capable of causing breaks.

DESCRIPTION OF THE PRIOR ART

As for frames of rackets which are made from a shaped metal section (FR-2,172,578 - U.S. Pat. No.-1,676,051), or from a composite structure of constant cross-sections (GB-1,536,873), these rackets are generally heavy since, in order to meet the criteria of robustness, a cross-section must be used which resists the maximum stresses, the consequence of which is that this cross-section is overdimensioned locally for less highly stressed points.

Furthermore, it is known to reinforce a racket frame by locally adding reinforcing fibers to its composition, which fibers are placed in the direction of stress and in the preferentially stressed zones (FR-2,544,208).

In order to limit their weight, it is known to make racket frames with a triangular or trapezoidal cross-section having more or less curved lines (DE-3,325,098). In this type of racket, the large base of the trapezoid or one side of the triangle is positioned perpendicular to the stringing plane and at all times on the outer face of the frame. In order to minimize the risks of the frame breaking, these rackets also must be overdimensioned locally in order to withstand the maximum stresses.

It is, moreover, known to provide rackets whose cross-section varies over the whole length of the frame, with the aim of improving playing qualities. The document EP-A-0,176,021, for example, relates to a tennis racket with a frame with a variable cross-section which is provided in order to optimize the return effect on the ball by matching the oscillation frequency of the frame to the ball/strings contact time. This racket has a thickness E (measured in the direction orthogonal to the plane of the racket) which is variable and which is maximum at the level of the arms, this thickness being, in fact, greater than that of the shaft.

Such an overdimensioning of the thickness of the frame probably leads to the risks of it breaking being avoided. However, the rackets obtained are very rigid with the result that although they may be appreciated by very good players, they are less suitable for beginners because of their low tolerance to the off centering of the point of impact of the ball and because of their lack of comfort.

It should furthermore be noted that the racket obtained may have an unpleasant appearance in the eyes of certain users who prefer to acquire a racket with a shapely appearance and one which is consequently rather elegant.

In order to simplify the manufacture of rackets with a cross-section with a shape which varies along the frame, it is known to use as a fibrous reinforcement a cord or "sleeve" with a constant perimeter which is easier to produce and which enables a profile to be obtained with a variable shape but with a constant perimeter (French Patent Application 88 06066). In this type of racket, the cross-section is comparable to a curved trapezoid having a large base perpendicular to the stringing plane and situated on the outer face of the frame.

All these rackets, with constant or variable profiles, have been dimensioned in order to resist the maximum stresses sustained, sometimes to the detriment of optimization in terms of costs or weight.

The present invention aims at overcoming the disadvantages of the existing rackets by providing a racket which is shapely, has a high performance, is strong and has a moderate cost price.

SUMMARY OF THE INVENTION

To this end, the tennis racket to which it relates, comprising a frame obtained from a shaped section whose cross-section is variable in shape, having a neutral axis situated at different distances from the internal edge and from the external edge of the frame, is one wherein the respective distances between the neutral axis and the internal and external edges of the frame vary along the periphery of the latter.

The neutral axis is defined as being the imaginary line at the level of which the moments of the tensile and compressive stresses being exerted on an elongate element are in equilibrium.

The variation in the shape of the cross-section, and therefore the variation in the quantity of fibrous reinforcements in the thickness of the wall which forms the composite material, entails a variation in the position of the neutral axis. It enables the frame to be reinforced locally in the desired zones and on the desired faces of the latter, inner or outer, without adding local reinforcements and without purposelessly increasing the cross-section of the frame. This therefore enables a racket frame to be made available which, whilst preserving a high level of performance, meet entirely the other criteria for the quality of a racket, namely: breaking strength, low weight, reasonable cost and attractive appearance.

According to a first embodiment, in each zone of the periphery of the frame, the neutral axis is located closer to that edge, internal or external, being subjected to the compressive stresses than to that edge, external or internal, being subjected to the tensile stresses, to the extent that the compressive strength of the material forming the frame is less than the tensile strength.

Indeed, it should be borne in mind that the tensile and compressive strengths are different, the tensile strength being of the order of 2.5 times greater than the compressive strength in the case of a glass-based composite material.

The neutral axis is advantageously located closest to the external edge of the frame in four zones of the latter corresponding, respectively, to the head, to the lower neck, and to the two zones situated half-way between the head and the lower neck.

Furthermore, the neutral axis is located closest to the internal edge of the frame in the four zones of the latter offset angularly by approximately 45° with the head and the lower neck.

According to an embodiment of this racket, the shape of the frame has, in the eight zones corresponding to the head, the lower neck, the zones situated half-way between them, as well as to the zones offset by 45° relative to the first, a curved trapezoidal cross-section and with the same shape and surface, the large base of the trapezoid being in each zone situated on the same side as the edge subjected to the compressive stresses.

In the transitional zones between the zones subjected to the maximum tensile and compressive stresses, the shaped section belonging to the frame has a different cross-section ensuring the passage from one trapezoidal section to another trapezoidal section pivoted by 180° relative to the first.

In these transitional zones, the compressive and tensile stresses are substantially in equilibrium with the result that the neutral axis is substantially centered relative to the internal and external edges of the frame.

The shape of the cross-section of the racket is advantageously such that the ratio of the distances between the neutral axis and the two edges of the frame, internal and external respectively, is equal to the ratio between the tensile and compressive strengths of the material forming the frame.

According to a simple embodiment of this racket, the perimeter of the cross-section of the frame is constant, independent of the location of the cross-section along the periphery of the frame.

According to another embodiment of this racket, the perimeter of the cross-section of the frame is variable depending on the location of the cross-section along the periphery of the frame.

The invention will, in any case, be better understood from the description which follows, made with reference to the attached schematic drawing showing, as a non-limiting example, an embodiment of this racket, in comparison with a conventional racket:

BRIEF DESCRIPTION OF THE DRAWINGS

FIG. 1 shows a tennis racket having a shaft 2 and a frame 3. Four dot-dash lines are traced on this frame which intersect at the central point O of the stringing space, a line y'y oriented longitudinally, a transverse line x'x and two lines m'm and n'n arranged at 45° to the first two lines.

Figure 1:
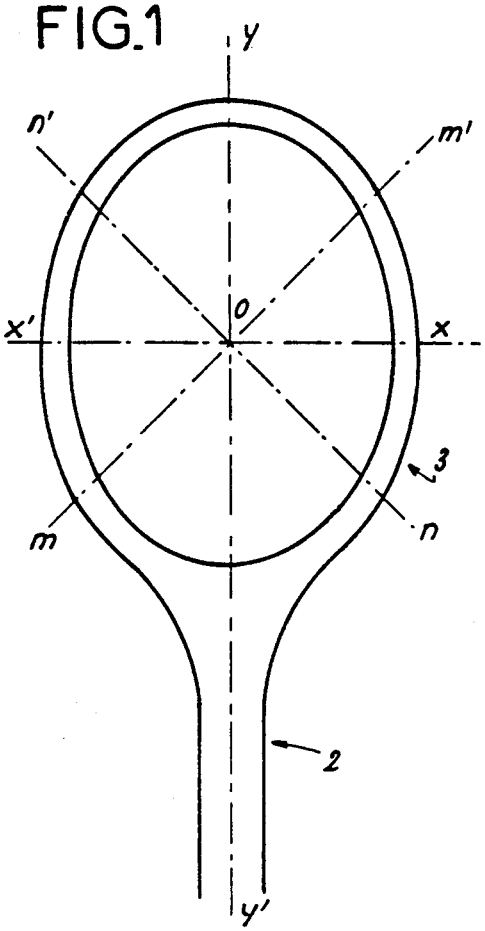
FIG. 1 is a highly schematic front view of a conventional tennis racket.
Figure 2:
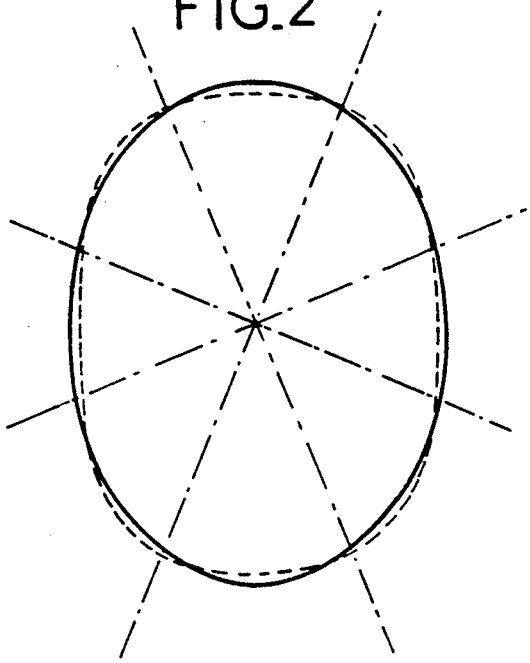
FIG. 2 shows, in broken, lines, the deformation of the frame under one type of stress.

It should be borne in mind that, as shown in FIG. 2, the frame of a racket is deformed in its plane during the stringing operation and then upon each impact by a ball. With the line shown in solid lines corresponding to a frame at rest, the latter assumes the position shown in broken lines after the strings have been tensioned or upon impact by a ball. It is clear that the action exerted by the strings in the longitudinal direction and in the transverse direction tends to deform the frame in order to give it a more "rectangular" shape than initially.

Localized stresses result from this deformation which are preferentially compressive stresses and tensile stresses depending on the point in question on the frame of the racket and depending on the edge of the frame concerned.

Figure 3:
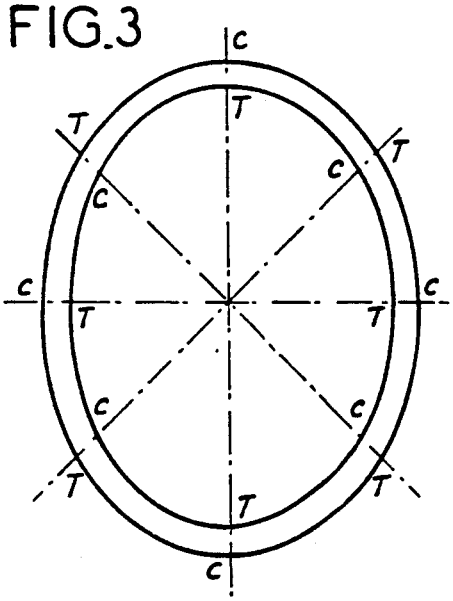
FIG. 3 is a view of a diagram showing the disposition of the resultant forces at different points of the frame of the racket.

FIG. 3 indicates, at the level of the different lines x'x, y'y, m'm and n'n, the resultants of the compressive and tensile forces on the two internal and external edges of the frame. Those zones being subjected to a compressive resultant force are referenced by the letter C, whereas the others being subjected to a tensile resultant force are referenced by the letter T.

DESCRIPTION OF THE PREFERRED EMBODIMENTS

Figure 4:
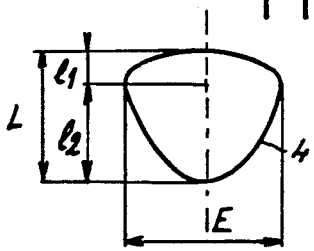
FIG. 4 is a schematic view in cross-section of the frame of the racket, on which view the thickness E and the width L have been marked.
Figure 5:
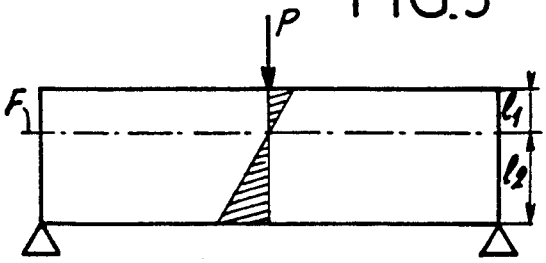
FIG. 5 shows the curve of the distribution of the stresses over one portion of the frame whose cross-section is shown in FIG. 4.

In order to produce a tennis racket from composite materials, and since the tensile and compressive strengths differ greatly, with a ratio of approximately 2.5, it is advantageous to use, in the zones where the stresses are out of equilibrium, trapezoidal or triangular curved shapes whose cross-section is such that the neutral axis F, which is situated on the side of the large base, as is clear from FIGS. 4 and 5, is situated at respective distances from the small base and the large base in the ratio $$\frac{l2}{l1} \simeq 2.5.$$

Figure 6:
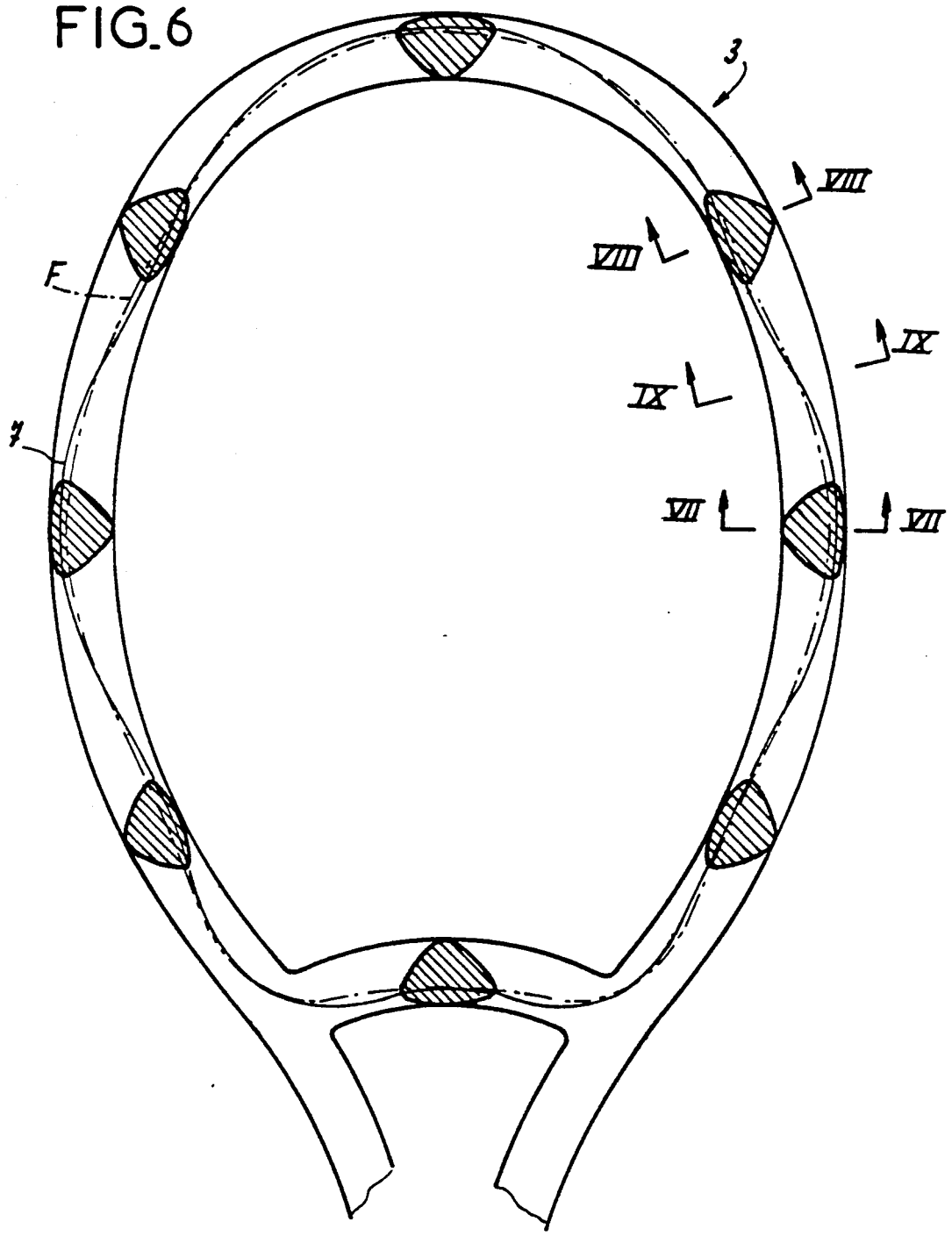
FIG. 6 shows a front view of the racket according to the invention showing cross-sections at different points of the frame.

FIG. 6 shows a racket according to the invention in which the frame has the shape of the shaped section in FIG. 4 in the zones situated in proximity to the intersections with the axes x'x, y'y, m'm and n'n.

Figure 7:
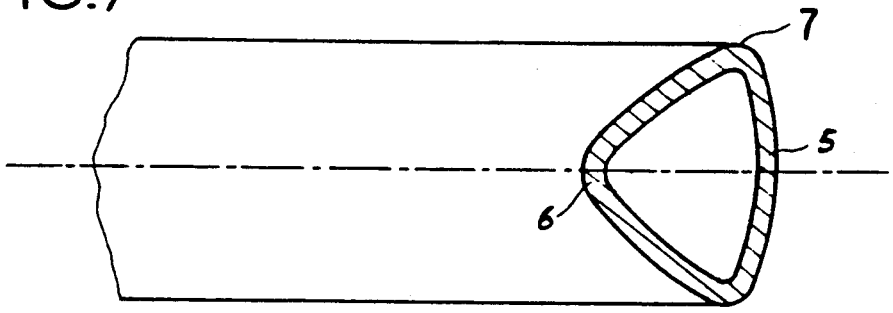
FIGS. 7, 8 and 9 are three sectional views of the frame of this racket along the lines VII—VII, VIII—VIII and IX—IX in FIG. 6.
Figure 8:
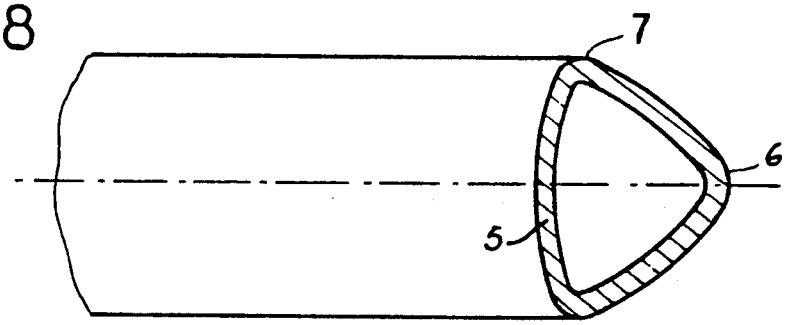
Figure 9:
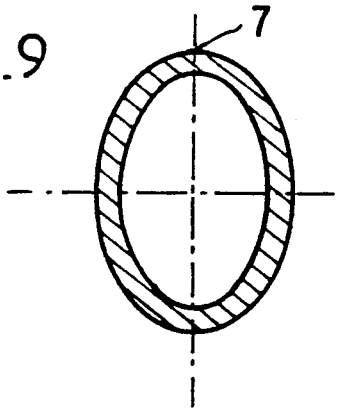

As shown in FIGS. 7 and 8, the large base 5 of the shaped section 4 is at all times situated on the side of the frame on which the compressive stresses are produced, while the small base 6 is turned to the side of the frame on which the tensile stresses act. The passage from one zone to the other is effected by a transitional zone where the compressive and tensile stresses are substantially in equilibrium and where the neutral axis F is centered. This structure results in a variation in the shape of the frame over its periphery, the position of the ridge line 7 being variable, as is that of the neutral axis F which is shown in dot-dash lines in FIG. 6. It should be noted that in the transitional zones the shaped section may have a shape which differs from that shown in FIG. 9, it being possible for the perimeter of the shaped section in this zone to be the same as in the zones where it has the shapes shown in FIGS. 7 and 8, or for it to have a different perimeter.

The thickness E of the cross-section of the frame and the width L of this same section may be constant, independent of the location along the periphery of the frame, or may vary as a function of it.

As is clear from the above, the invention provides a great improvement to the existing art by providing a tennis racket whose frame has a high degree of strength, by limiting the risks of cracking and without necessitating local mechanical reinforcements or a substantial increase in the cross-section over the entire periphery of the frame. The result is a high-performance racket which is economical to produce, attractive in appearance and light.

It goes without saying that the invention is not limited just to the embodiment of this racket described above by way of example; on the contrary, it encompasses all the alternative embodiments. It would thus be possible, in particular, for the cross-section of the frame to differ, or alternatively for this racket to be applied to other types of games, such as squash.

We claim:

1. A racket for ball games, the racket having a neutral axis about which tensile and compressive stresses in the racket are in equilibrium, comprising:

a frame having a periphery, said frame having an internal edge and an external edge, said frame having a cross-section, the shape of the cross-section varying along the frame, whereby the distance of the neutral axis from the inside and outside edges of the frame varies along the periphery of the frame; and wherein the periphery of the frame has a plurality of zones in which the tensile stresses and the compressive stresses vary and wherein the neutral axis is located closer to the edge subjected to compressive stresses than to the edge subjected to tensile stresses in relation to the extent that the compressive strength of the material forming the frame is less than the tensile strength of the material forming the frame.

2. A racket as in claim 1, wherein the frame includes a head zone, a neck zone in opposed relation to the head zone and two opposed side zones located half-way between the head zone and the neck zone and wherein the neutral axis located closer to the external edge of the frame in each of the head, neck and side zones.

3. A racket as in claim 2, wherein the frame includes four intermediate zones, each intermediate zone being located between the head zone and one of the side zones or the neck zone and one of the side zones and wherein the neutral axis is located closer to the internal edge of the frame in each of the intermediate zones.

4. A racket as in claim 3, wherein the cross-sectional shape of the frame in the head, neck, side, and the intermediate zones is of substantially the same shape and size, said shape being substantially trapezoidal, said trapezoidal shape having a longer base side and a smaller top side, with the larger base side of the trapezoidal shape being situated in each zone closer to the edge of the zone being subjected to compressive stresses.

5. A racket as in claim 4, wherein the base side and the top side of the trapezoidal shape are curved.

6. A racket as in claim 5, wherein the frame includes a plurality of transition zones, each transition zone located between each of the head, neck, side and intermediate zones, the cross-sectional shape of the transition zones being different from the crosssectional shape of the head, neck, side and intermediate zones to ensure transition from the curved trapezoid cross-section of one zone to an adjacent zone, the trapezoidal cross-section of the adjacent zone being disposed in a position rotated 180° with respect to said one zone.

7. A racket as in claim 1, wherein the shape of the cross-section of the frame is such that the ratio of the distances between the neutral axis and the internal edge and the neutral axis and the external edge is equal to the ratio of the tensile strength to the compressive strength of the material forming the racket.

8. A racket as in claim 1, wherein the perimeter of the cross-section of the frame varies in relation to the location of the cross-section along the periphery of the frame.

9. The racket as claimed in claim 1, wherein the perimeter of the cross-section of the frame is constant along the periphery of the frame.

10. The racket as claimed in claim 1, wherein the thickness of the cross-section is constant along the periphery of the frame.

11. The racket as claimed in claim 1, wherein the width of the cross-section is constant along the periphery of the frame.

12. A racket for ball games comprising:

a peripheral frame, said frame having an inner edge and an outer edge, said frame being subjected to predominantly compressive stress and predominantly tensile stress in alternating zones of the frame;

said frame having a neutral axis defined between the inner edge and the outer edge, wherein tensile and compressive stresses in the frame are in balance about said neutral axis;

said frame having a cross-section which varies along the frame such that the neutral axis is alternately cyclically located nearer to the inner edge than the outer edge, and, then, nearer to the outer edge than the inner edge.

13. A racket as in claim 12, wherein the frame includes a head zone, a neck zone in opposed relation to the head zone and two opposed side zones located half-way between the head zone and the neck zone and wherein the neutral axis is located closer to the outer edge of the frame than to the inner edge of the frame in each of the head, neck and side zones.

14. A racket as in claim 13, wherein the frame includes four intermediate zones, said intermediate zones being located between the head zone and respective ones of the side zones and between the neck zone and respective ones of the side zones and wherein the neutral axis is located closer to the inner edge of the frame than to the outer edge of the frame in each of the intermediate zones.

15. A racket as in claim 12, wherein the cross-sectional shape of the frame is of a substantially constant shape and size, said shape being substantially trapezoidal, said trapezoidal shape having a longer base side and a smaller top side, with the longer base side of the trapezoidal shape in each zone being closer to the edge of the zone which is subjected to compressive stress.

16. A racket as in claim 15, wherein the base side and the top side of the trapezoidal shape are curved.

17. A racket as in claim 16, wherein the frame includes a plurality of transition zones, each transition zone being located between adjacent said alternating zones, the cross-sectional shape of the transition zones being different from the cross-sectional shape of the alternating zones to ensure transition from the curved trapezoidal cross-section of one alternating zone to an adjacent alternating zone, the trapezoidal cross-section of said adjacent alternating zone being disposed in a position rotated 180° with respect to the trapezoidal cross-section of said one alternating zone.

* * * * *